US006389645B1

(12) United States Patent
Polidoro

(10) Patent No.: US 6,389,645 B1
(45) Date of Patent: May 21, 2002

(54) CASHBOX HANDLE

(75) Inventor: Roberto Polidoro, Genève (CH)

(73) Assignee: Mars Incorporated, McLean, VA (US)

( * ) Notice: Subject to any disclaimer, the term of this patent is extended or adjusted under 35 U.S.C. 154(b) by 0 days.

(21) Appl. No.: 09/530,151

(22) PCT Filed: Oct. 28, 1998

(86) PCT No.: PCT/IB98/01767

§ 371 Date: Jun. 28, 2000

§ 102(e) Date: Jun. 28, 2000

(87) PCT Pub. No.: WO99/22345

PCT Pub. Date: May 6, 1999

(30) Foreign Application Priority Data

Oct. 29, 1997 (GB) ..... 9722870

(51) Int. Cl.[7] ..... A45C 7/00; A45F 5/10

(52) U.S. Cl. ..... 16/405; 16/429; 16/444; 220/762

(58) Field of Search ..... 16/405, 429, 444, 16/445, 438, 408, 144.1; 220/756, 761, 762, 763; 190/115, 39

(56) References Cited

U.S. PATENT DOCUMENTS

| | | | | | |
|---|---|---|---|---|---|
| 2,364,073 | A | | 12/1944 | Howard | 220/94 |
| 3,113,651 | A | * | 12/1963 | Szabo et al. | 16/405 |
| 3,388,416 | A | * | 6/1968 | Szabo | 16/405 |
| 3,431,586 | A | * | 3/1969 | Bush | 16/405 |
| 3,892,331 | A | * | 7/1975 | Beck | 16/429 |
| 3,988,802 | A | * | 11/1976 | Bruni et al. | 16/405 |
| 4,095,711 | A | | 6/1978 | Conley | 220/94 R |
| 4,117,914 | A | * | 10/1978 | Snyder | 16/405 |
| 4,529,118 | A | | 7/1985 | Granzow et al. | 232/43.3 |
| 4,638,746 | A | | 1/1987 | Ishigure | 109/52 |
| 4,928,800 | A | | 5/1990 | Green et al. | 190/115 |
| 5,075,925 | A | | 12/1991 | Maloney | 16/112 |
| 5,553,712 | A | | 9/1996 | Tisbo et al. | 206/752 |
| 6,115,883 | A | * | 9/2000 | Um | 16/405 |

FOREIGN PATENT DOCUMENTS

| | | | |
|---|---|---|---|
| EP | 0 600 323 A1 | 11/1993 | B65D/79/00 |
| EP | 0 662 675 A2 | 1/1995 | G07F/9/06 |
| FR | 2 712 257 | 11/1993 | B65D/25/32 |
| GB | 291564 | 6/1928 | |
| GB | 678514 | 9/1952 | |
| GB | 1004026 | 9/1965 | A45C/13/26 |
| GB | 1053940 | 1/1967 | A45C/13/26 |
| GB | 1162136 | 8/1969 | A47B/95/02 |

* cited by examiner

*Primary Examiner*—Chuck Y. Mah
(74) *Attorney, Agent, or Firm*—Fish & Richardson P.C.

(57) ABSTRACT

A cashbox (14) has a handle (2) which is movable from a storage position to a use position. The handle (2) is attached to the cashbox (14) by means allowing both pivotal and translational movement so as to allow a substantial space between the gripping portion (6) of the handle (2) and the cashbox (14) with the handle (2) in its use position. A support stay (28) is pivoted to both the cashbox (14) and the handle (2). The stay (28) defines the path of movement of the handle (2), and tends to resist collapsing of the handle (2) when the handle (2) is used for trusting the cashbox (14) into a cash handling apparatus.

7 Claims, 2 Drawing Sheets

CASHBOX HANDLE

This invention relates to handles, and particularly handles for cashboxes for containing currency, e.g. banknotes. These generally need to be loaded into cash handlers, for example banknote validators, and it is therefore desirable for the cashboxes to be relatively compact. Accordingly, there is a desire for any handle provided on the cashbox also to be compact and preferably collapsible.

The conventional cashbox handle is simply a gripping portion having a pair of arms which are pivoted to the cashbox. The arms need to be relatively long to allow for an easy grip, and this means that when the handle is pivoted to its storage position the gripping portion often extends beyond the side of the cashbox, which is inconvenient and contrary to the requirement for a compact structure.

This problem could be mitigated by shifting the pivot axis of the handle away from the centreline of the cashbox. However, this makes carrying more difficult. Also, cashbox handles are often used for thrusting the cashbox into position within a handling apparatus, which would be more difficult if the pivot axis is offset from the centreline.

It would be desirable to provide a more compact cashbox handle, and one which is suitable for allowing its use in thrusting the cashbox into position within a handling apparatus.

According to one aspect of the invention there is provided a cashbox handle which is mounted to a cashbox by means which allow both pivotal and translational movement. The arrangement is such that when the handle is in its flat, storage position, the attachment means are displaced from the centreline of the cashbox. As the handle is pivoted to its use position, however, the translational movement allows the attachment means to move towards the centreline. This allows the use of a handle which is substantially spaced from the cashbox to facilitate gripping when in use, but which, when stored flat, does not overhang the side of the cashbox.

Preferably, the cashbox handle is provided with a support, or stay, which is pivotably mounted on the one hand to the gripping portion and the other hand to the cashbox. This therefore defines the path of movement of the gripping portion as the handle is moved between its storage and use positions. It also assists in keeping the handle in position when it is used for thrusting the cashbox into a handling apparatus.

An arrangement embodying the invention will now be described by way of example with reference to the accompanying drawings, in which.

Figure 1:
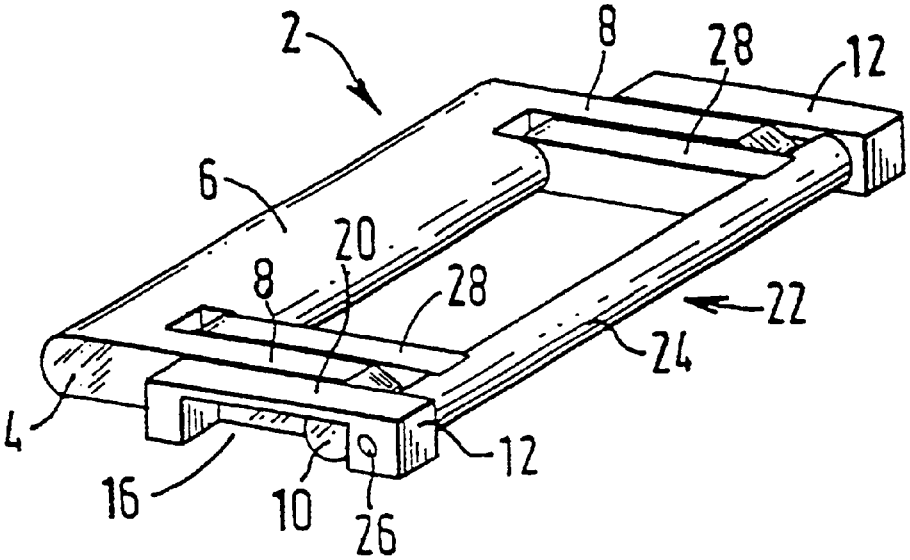
FIG. 1 is a perspective view of a handle in accordance with the invention, in its collapsed state.

Referring to the drawings, the handle 2 comprises a gripping member 4 which is generally "U"-shaped in configuration and has a gripping portion 6, two arms 8 extending from opposite ends of the gripping member, and a pair of shaft portions 10 each of which projects outwardly from a respective one of the arms 8.

The cashbox is provided with fixing blocks 12 each of which is generally "U"-shaped and which, when mounted on the cashbox 14, defines an elongate aperture 16 between a central flange 20 and the upper surface 38 of the cashbox.

Each of the shaft portions 10 is turnable and slidable within an aperture 16.

Figure 2:
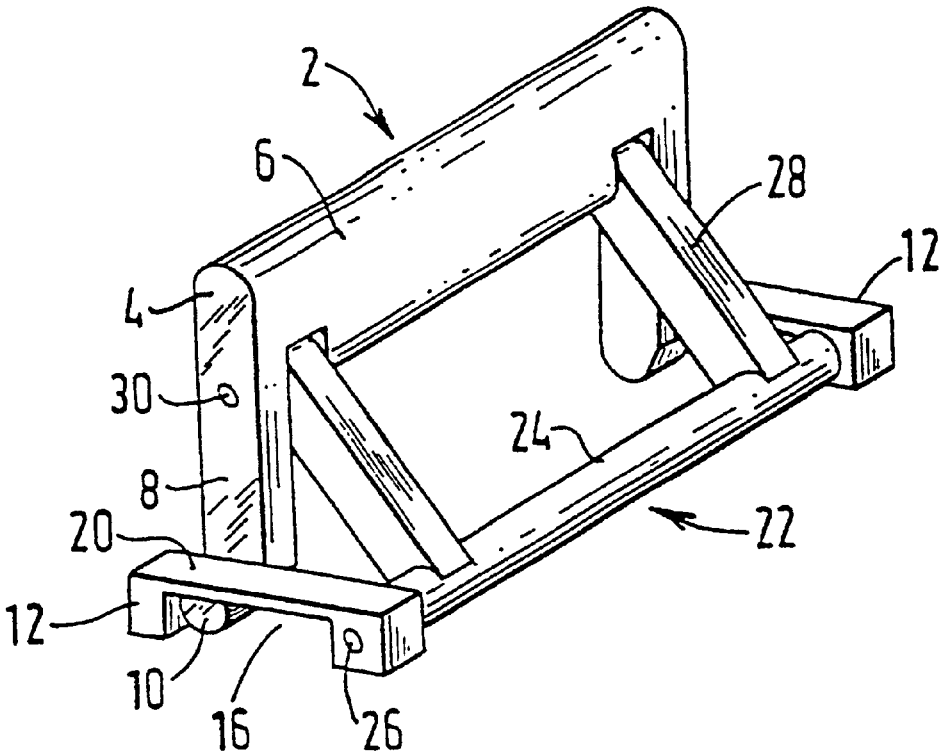
FIG. 2 is a view similar to that of FIG. 1, except that it shows the handle in its use position.
Figure 3:
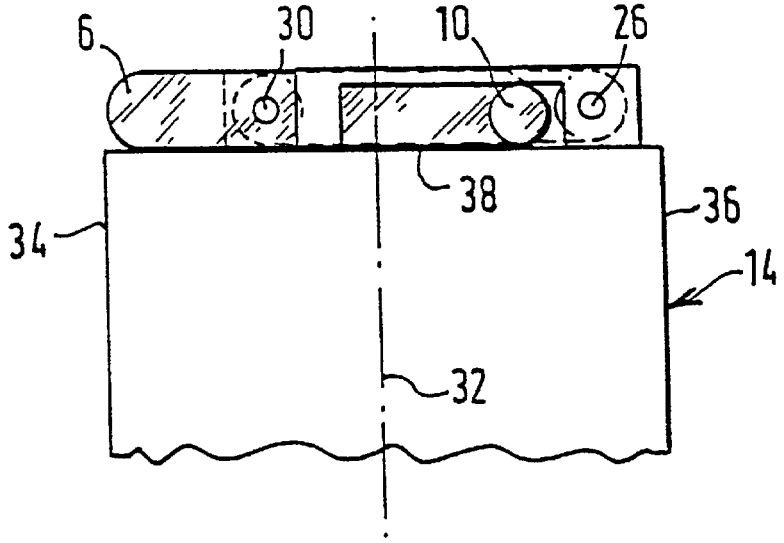
FIG. 3 is a diagrammatic end elevation showing the handle in its collapsed state on a cashbox.
Figure 4:
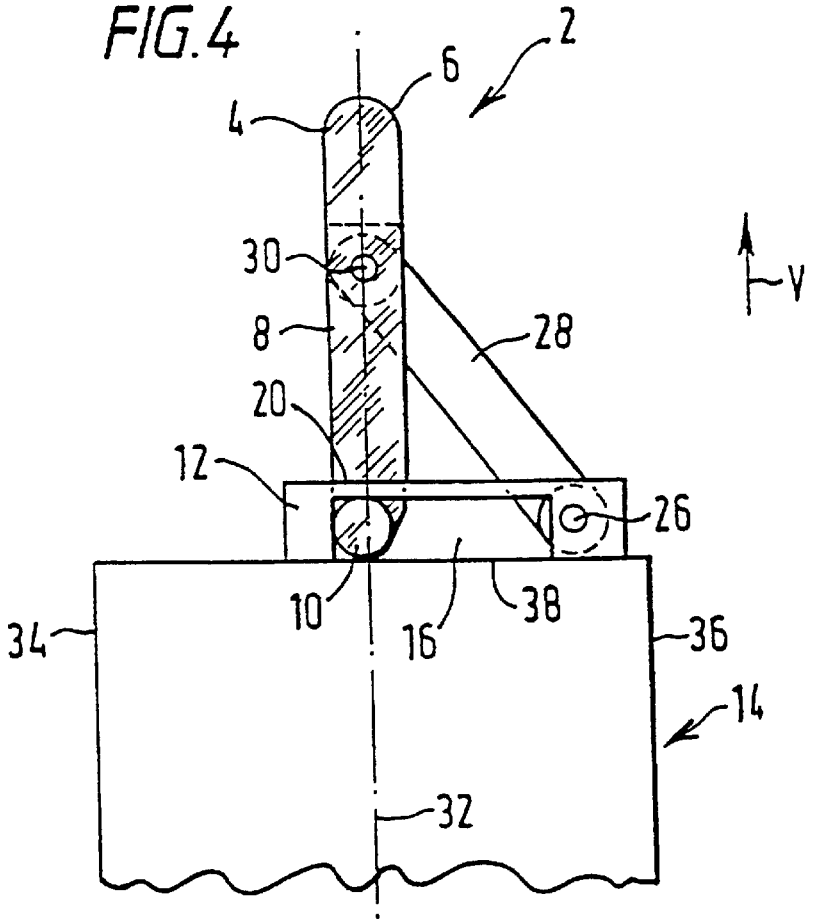
FIG. 4 is a diagrammatic end elevation of the handle on the cashbox in its use position.

This allows the handle to be pivoted from the position shown in FIGS. 1 and 3 to the position shown in FIGS. 2 and 4, the shaft portions 10 turning clockwise and moving left within the aperture 16 during the course of this movement The handle 2 also comprises a support member 22 comprising a shaft 24 mounted for rotation about its axis on a spindle 26 which is fixed within the blocks 12, at the ends thereof close to the shaft portions 10 when the handle is in its collapsed position. The support member 22 also has a pair of support arms 28 which, when the handle is in its collapsed position, lie alongside the grip member arms 8. The remote ends of the arms 28 are pivotably mounted to the gripping portion 6 of the member 4 about an axis 30.

The support member 22 constrains the movement of the grip member 4 as it is pivoted to its use position. The arrangement is such that as the shaft portions 10 reach the end of their travel, the grip member 4 is in a substantially vertical position, with the grip portion 6 overlying the centre of gravity of the cashbox 14. FIG. 4 shows in a broken line 32 the position of the centreline of the cashbox, on which the centre of gravity lies.

FIG. 4 shows the cashbox in its carrying position, with the arrow V pointing directly upwardly. The weight of the cashbox is supported by the action of the shaft portions 10 on the flanges 20.

It is to be noted that, if as in the prior art the shaft portions 10 could not move laterally from the position shown in FIG. 4 (assuming that the support member 22 did not exist) then collapsing of the handle would mean that the gripping portion 6 would extend beyond the side wall 34 or 36 of the cashbox 14.

The handle 2 can also be used for thrusting the cashbox into position within a cash handling apparatus. In this case, the forces will be transmitted from the gripping portion 6 downwardly along the arms 8 through the shaft portions 10 against the upper surface 38 of the cashbox. This would normally occur when the cashbox is in a different orientation, for example, with reference to FIG. 4, the orientation in which the vertically upward direction extends perpendicular to the plane of the drawing.

Preferably, biasing means are provided to bring the cashbox handle back to its collapsed position as shown in FIGS. 1 and 3. For example, there may be a spring mounted about the spindle 26 to bias the support arms 28 anticlockwise (as seen in FIG. 4) to the position shown in FIG. 3. Additionally, or alternatively, there may be a spring provided about the axis 30 which tends to bias the grip member arms 8 in an anticlockwise direction and the support arms 28 in a clockwise direction, again so that the arms would tend to adopt the orientation shown in FIG. 3.

With the arrangement described above, when the handle is being used for carrying, the gripping portion 6 is located over the centre of gravity of the cashbox, which is located on the centreline 32. When pushing the cashbox using the handle, the direction of thrust also passes through the centre of gravity. Any tendency for the handle to turn clockwise or anticlockwise about the shaft portions 10 will be resisted by the support arms 28. Also, the handle cannot collapse because any anticlockwise force on the support arms 28 will be resisted by the reaction between the shaft portions 10 and the upper surface 38 of the cashbox 14, because the point of contact is directly beneath the pivot axis 30.

Accordingly, using a handle of the invention, an operator can comfortably push against the handle during the cashbox insertion phase without the adverse pivoting which would arise with a conventional handle.

However, if the shaft portions 10 were to be forcibly moved to the right as shown in FIG. 4, by slightly twisting the grip member 4 anticlockwise about the axis 30, then both the grip arms 8 and the support arms 28 will be free to move anticlockwise because his will tend to cause the shaft portions 10 to rotate anticlockwise and move further to the right, so that the handle is moved (for example under the force of the springs) rapidly back to the position shown in FIG. 3. the handle of the preferred embodiment is also easy to exchange in the case of damage. To facilitate this, if desired, all the elements shown in FIGS. 1 and 2 may be mounted on a common base plate (not shown) to form a unit.

Although the invention has been described in the context of cashboxes, it would be possible to use the handle for other purposes.

What is claimed is:

1. A cashbox having a handle comprising a grip member having an attachment portion attaching the grip member to the cashbox, the grip member being mounted on the cashbox in such a way that the grip member can be pivoted from a storage position, where a gripping portion thereof is close to the cashbox, and a use position, where the gripping portion is spaced from the cashbox, while the attachment portion of the grip member moves laterally with respect to the cashbox, the handle farther comprising a support member pivotally mounted to the cashbox and to the grip member.

2. A cashbox as claimed in claim 1, wherein the centre of gravity of the cashbox, the attachment portion and the gripping portion are substantially aligned when the grip member is in the use position.

3. A cashbox as claimed in claim 2, wherein the support member is pivotally mounted to the grip member at a point or points which is or are aligned with the centre of gravity of the cashbox, the attachment portion and the gripping portion when the grip member is in its use position.

4. A cashbox as claimed in claim 1, wherein the support member is pivotally mounted to the gripping portion of the grip member.

5. A cashbox as claimed in claim 1, wherein the support member is pivotally mounted to the cash box at a point or points close to the attachment portion of the grip member when the grip member is in the storage position.

6. A cashbox as claimed in claim 1, including biasing means for biasing the grip member to its storage position.

7. A cashbox handle assembly having a handle comprising a grip member having an attachment portion for movably attaching the grip member to the cashbox, a support member pivotally mounted to the grip member and means for mounting the handle to a cashbox, the assembly being such that the grip member can be pivoted from a storage position, where a gripping portion thereof is close to the cashbox, and a use position, where the gripping portion is spaced from the cashbox, while an attachment portion of the grip member moves laterally with respect to the cashbox, the assembly also being and such that the support member is pivotally mounted to the cashbox.

* * * * *